US011411335B2

(12) United States Patent
Ye et al.

(10) Patent No.: US 11,411,335 B2
(45) Date of Patent: Aug. 9, 2022

(54) ELECTRICAL CONNECTION COMPONENT AND METHOD OF MANUFACTURING THE SAME

(71) Applicant: Yazaki Corporation, Tokyo (JP)

(72) Inventors: Nan Ye, Shizuoka (JP); Toshitaka Kubo, Ibaraki (JP); Tetsuo Shimizu, Ibaraki (JP)

(73) Assignee: YAZAKI CORPORATION, Tokyo (JP)

( * ) Notice: Subject to any disclaimer, the term of this patent is extended or adjusted under 35 U.S.C. 154(b) by 68 days.

(21) Appl. No.: 17/165,401

(22) Filed: Feb. 2, 2021

(65) Prior Publication Data

US 2021/0242618 A1 Aug. 5, 2021

(30) Foreign Application Priority Data

Feb. 3, 2020 (JP) ..... JP2020-016117

(51) Int. Cl.

| | |
|---|---|
| ***H01R 4/48*** | (2006.01) |
| ***H01R 13/03*** | (2006.01) |
| ***C25D 13/02*** | (2006.01) |
| ***H01R 43/00*** | (2006.01) |

(52) U.S. Cl.
CPC ..... *H01R 13/03* (2013.01); *C25D 13/02* (2013.01); *H01R 43/00* (2013.01)

(58) Field of Classification Search
CPC H01R 13/2442; H01R 23/7068; H01R 13/04; H01R 23/7073; H01R 12/57; H01R 113/193
USPC ..... 439/862
See application file for complete search history.

(56) References Cited

U.S. PATENT DOCUMENTS

2022/0115802 A1* 4/2022 Ando ..... H01R 13/187
2022/0131298 A1* 4/2022 Osada ..... H01R 13/193

FOREIGN PATENT DOCUMENTS

JP 2013-151398 A 8/2013

* cited by examiner

*Primary Examiner* — Phuong Chi Thi Nguyen
(74) *Attorney, Agent, or Firm* — Sughrue Mion, PLLC

(57) ABSTRACT

An electrical connection component includes a connecting part that is electrically conductive, and an electrical contact on at least a part of a surface of the connecting part, the electrical contact including a graphene oxide film. The graphene oxide film is graphene oxide or a stack of graphene oxide, and a thickness of the graphene oxide film is 1 nm or more and 50 nm or less. The electrical connection component may be either a male terminal or a female terminal.

3 Claims, 5 Drawing Sheets

ELECTRICAL CONNECTION COMPONENT AND METHOD OF MANUFACTURING THE SAME

CROSS-REFERENCE TO RELATED APPLICATIONS

The present application is based on, and claims priority from Japanese Patent Application No. 2020-016117, filed on Feb. 3, 2020, the entire contents of which are incorporated herein by reference.

TECHNICAL FIELD

The present disclosure relates to an electrical connection component and a method of manufacturing the same.

BACKGROUND

Electrical connection components, such as terminals, are to have high electrical conductivity and high wear resistance at electrical contacts with opposite terminals. A typical contact is thus plated with a precious metal, such as gold, silver, or tin. However, use of expensive precious metal plating tends to increase the production cost of the terminals. Accordingly, it has been proposed to apply a graphene film instead of precious metal plating to the electrical contacts of the terminals.

JP 2013-151398A discloses a method of manufacturing an electrode material made of a reduced graphene oxide by reducing graphene oxide by irradiating the graphene oxide with light while applying an AC voltage to efficiently reduce graphene oxide. This method provides an electrically conductive reduced graphene oxide from electrically insulating graphene oxide. JP 2013-151398A uses the reduced graphene oxide as a material of an oxygen reduction electrode, such as a fuel cell, or an electrode material of a supercapacitor.

SUMMARY

The method of manufacturing the electrode material described in JP 2013-151398A provides the reduced graphene oxide. It however includes caning out, in separate steps, the step of obtaining the electrode to which graphene oxide is attached and the step of reducing the graphene oxide. Compared with graphene oxide, the reduced graphene oxide has excellent electrical conductivity, while the step of reducing graphene oxide is included and the production cost by this step increases.

The present disclosure is made in view of the above issue. An object of the present disclosure is to provide an electrical connection component having low electrical resistance while using graphene oxide, and a method of manufacturing the same.

An electrical connection component according to one aspect of the present disclosure includes a connecting part that is electrically conductive, and an electrical contact on at least a part of a surface of the connecting part, the electrical contact including a graphene oxide film. The graphene oxide film is graphene oxide or a stack of graphene oxide, and a thickness of the graphene oxide film is 1 nm or more and 50 nm or less.

The electrical connection component may be either a male terminal or a female terminal.

A method of manufacturing the electrical connection component according to another aspect of the present disclosure including forming the graphene oxide film by an electrophoretic deposition method.

The present disclosure provides an electrical connection component having low electrical resistance while using graphene oxide, and a method of manufacturing the same.

DETAILED DESCRIPTION

Figure 1:
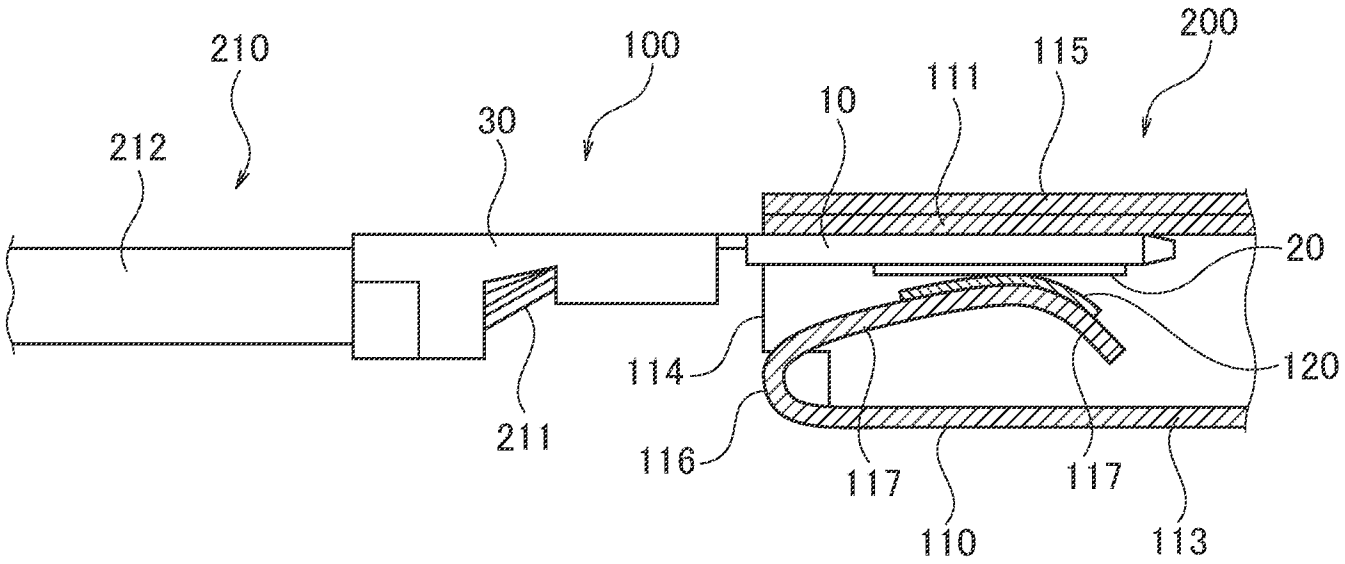
FIG. 1 is a sectional view of an example of a male terminal and a female terminal in an engaged state.

The following describes an electrical connection component and a method of manufacturing the same according to the present embodiment in detail with reference to the drawings. Dimensional ratios in the drawings are exaggerated for explanation and may differ from the actual ratios.

[Electrical Connection Component]

The electrical connection component according to the present embodiment includes a connecting part that is electrically conductive, and an electrical contact that is provided on at least a part of the surface of the connecting part and formed from a graphene oxide film. The graphene oxide film is graphene oxide or a stack of graphene oxide, and the thickness of the graphene oxide film is 1 nm or more and 50 nm or less. Graphene oxide film itself has high electrical resistance. However, in the electrical connection component according to the present embodiment, the thickness of the graphene oxide film is 50 nm or less, so that the electrical resistance of the graphene oxide film is low.

With reference to FIGS. 1 to 6, a male terminal 100 and a female terminal 200 are described as an example of an electrical connection component according to the present embodiment. FIG. 1 is a sectional view of an example of the male terminal 100 and the female terminal 200 in an engaged state. As illustrated in FIG. 1, the male terminal 100 and the female terminal 200 are configured to engage with each other when a connecting part 10 of the male terminal 100 is inserted in a connecting part 110 of the female terminal 200. When the male terminal 100 is engaged with the female terminal 200, the connecting part 10 of the male terminal 100 and the connecting part 110 of the female terminal 200 are physically and electrically connected to each other. As described later, the connecting part 10 and the connecting part 110 are electrically conductive, and thus when an electrical contact 20 and an electrical contact 120 come into contact with each other, there is an electrical connection between an electric wire 210 connected to the male terminal 100 and an electric wire 210 connected to the female terminal 200.

(Male Terminal)

Figure 2:
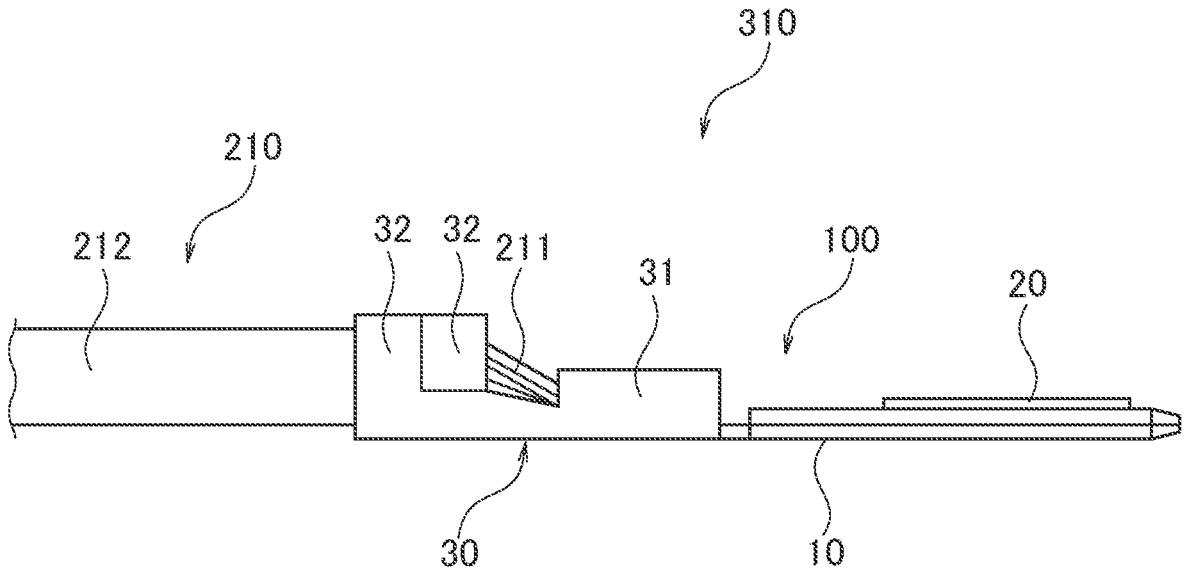
FIG. 2 is a front view of an example of an electric wire with terminal in which an electric wire is crimped to the male terminal illustrated in FIG. 1.
Figure 3:
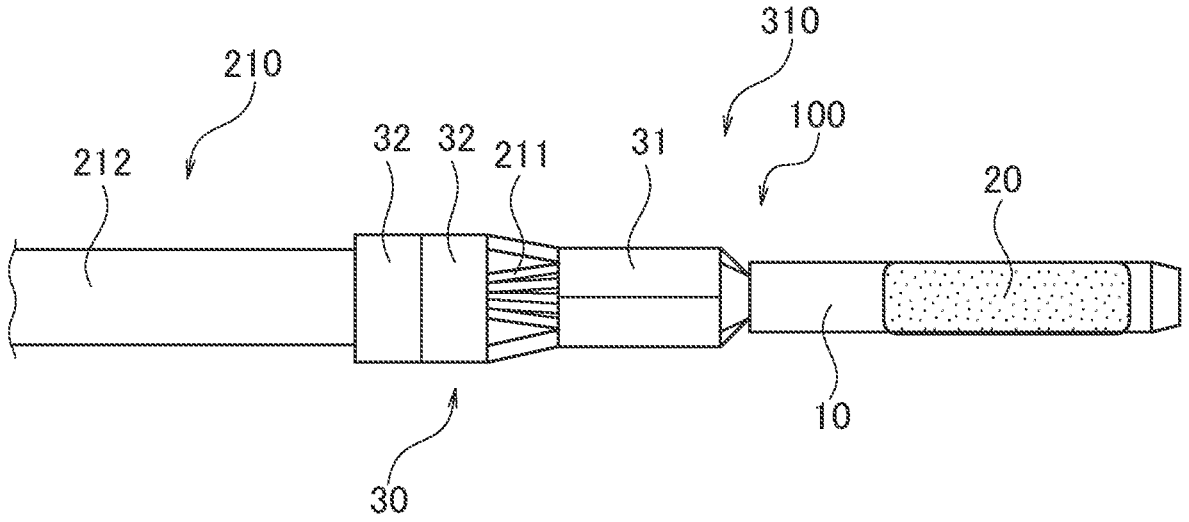
FIG. 3 is a plan view of the electric wire with terminal illustrated in FIG. 2.

First, with reference to FIGS. 2 and 3, the male terminal 100 is described. FIG. 2 is a front view of an example of an electric wire with terminal 310 in which the electric wire 210 is crimped to the male terminal 100 illustrated in FIG. 1. FIG. 3 is a plan view of the electric wire with terminal illustrated in FIG. 2. As illustrated in FIGS. 2 and 3, the male terminal 100 includes the connecting part 10 and the electrical contact 20. The male terminal 100 may further include a crimping part 30.

The male terminal 100 is formed from an electrically conductive member. The electrically conductive member is preferably a metal having electrical conductivity, such as copper, aluminum, iron, magnesium, an alloy containing one of these metals, or the like. The connecting part 10 and the crimping part 30 of the male terminal 100 are formed from a sheet of an electrically conductive member, and the connecting part 10 and the crimping part 30 have electrical conductivity. However, the male terminal 100 may be formed from multiple separate members of different types.

The connecting part 10 of the male terminal 100 is electrically conductive and configured to engage with the connecting part 110 of the female terminal 200. The connecting part 10 is plate-like and formed into a substantially rectangular parallelepiped shape by stacking metal plates.

The electrical contact 20 is provided on at least a part of the surface of the connecting part 10. At least the part of the surface of the connecting part 10 may be on an outer side of the connecting part 10 that contacts the female terminal 200 through the electrical contact 20 of the male terminal 100 when engaged with the female terminal 200. The electrical contact 20 may be provided on a part of one of two sides, each of which has a large area, included in the surface of the connecting part 10 in a plate-like shape. The electrical contact 20 of the male terminal 100 is configured to be physically and electrically connected to the electrical contact 120 of the female terminal 200 when engaged with the female terminal 200.

The electrical contact 20 is formed from a graphene oxide film. The graphene oxide film is graphene oxide or a stack of graphene oxide. Graphene oxide has high chemical stability and mechanical strength similar to graphene, and thus the contact reliability of the male terminal 100 is improved by forming the electrical contact 20 with the graphene oxide film. Graphene oxide is synthesized by chemically oxidizing inexpensive and mass-available graphite.

When graphene oxide is reduced, graphene is obtained. Graphene is a one-atom-thick film material having a planar hexagonal lattice structure formed by $sp^2$ bonds between carbon atoms. The electrical conductivity of graphene is higher than that of insulating graphene oxide, and thus graphene that is reduced graphene oxide is usually used for areas where electrical conductivity is required. Graphene is superior to graphene oxide in electrical conductivity, but a process for reducing graphene oxide is necessary. However, in the present embodiment, the thickness of the graphene oxide film is within a predetermined range, and thus the electrical resistance of the electrical contact is low while graphene oxide is used.

The thickness of the graphene oxide film is 1 nm or more and 50 nm or less. The size of one carbon atom is approximately 0.335 nm, and the thickness of one graphene oxide layer is approximately 1 nm. The graphene oxide film includes a case of graphene oxide in a single layer, and thus the lower limit of the thickness of the above graphene oxide film is set to 1 nm. Setting the thickness of the graphene oxide film to 50 nm or less reduces the distance from the electrical contact 120 of the female terminal 200 to the connecting part 10 of the male terminal 100 and reduces the electrical resistance of the graphene oxide film. The thickness of the graphene oxide film is preferably 14 nm or less, and more preferably 8 nm or less. The thickness of the graphene oxide film is obtained by observing the cross section of the graphene oxide film by a scanning electron microscope (SEM) or a transmission electron microscope (TEM) and measuring the thickness.

The number of layers of graphene oxide in the graphene oxide film is preferably 1 or more and 30 or less. Setting the number of layers of graphene oxide in such a range provides the male terminal 100 having excellent electrical conductivity.

When the number of layers of graphene oxide in the graphene oxide film is two or more, an electrically conductive metal may be intercalated between the layers of graphene oxide. Intercalation of the electrically conductive metal reduces the electrical resistance between the layers of graphene oxide. The electrically conductive metal is not limited as long as it has electrical conductivity. It may be gold, silver, copper, tin, nickel, iron, aluminum, a mixture of some of these metals, or the like.

The crimping part 30 is connected to the connecting part 10 and is configured to crimp the electric wire 210. The crimping part 30 includes a conductor crimping part 31 for crimping a conductor 211 of the electric wire 210, and a covering material crimping part 32 for crimping a covering material 212 of the electric wire 210. In the crimping part 30, at least the conductor crimping part 31 is formed from a material having electrical conductivity. For the electrically conductive material, a material similar to that used for the connecting part 10 of the male terminal 100 is used, for example.

The electric wire 210 includes the conductor 211 and the covering material 212 covering the conductor 211. The material of the conductor 211 may be, for example, copper, aluminum, an alloy containing one of these metals, or the like, and is preferably lightweight aluminum or an aluminum alloy. The material of the covering material 212 may be a resin, and is preferably a a resin containing an olefin resin or polyvinyl chloride (PVC) as a main component. Here, the main component means a component of 50% by mass or more of the entirety of the covering material 212. The olefin resin may be, for example, one or more resins selected from the group consisting of polyethylene (PE), polypropylene (PP), ethylene copolymer, and propylene copolymer. Among these resins, resins mainly containing polypropylene (PP) or polyvinyl chloride (PVC) are preferable because of their high flexibility and durability.

(Female Terminal)

Figure 4:
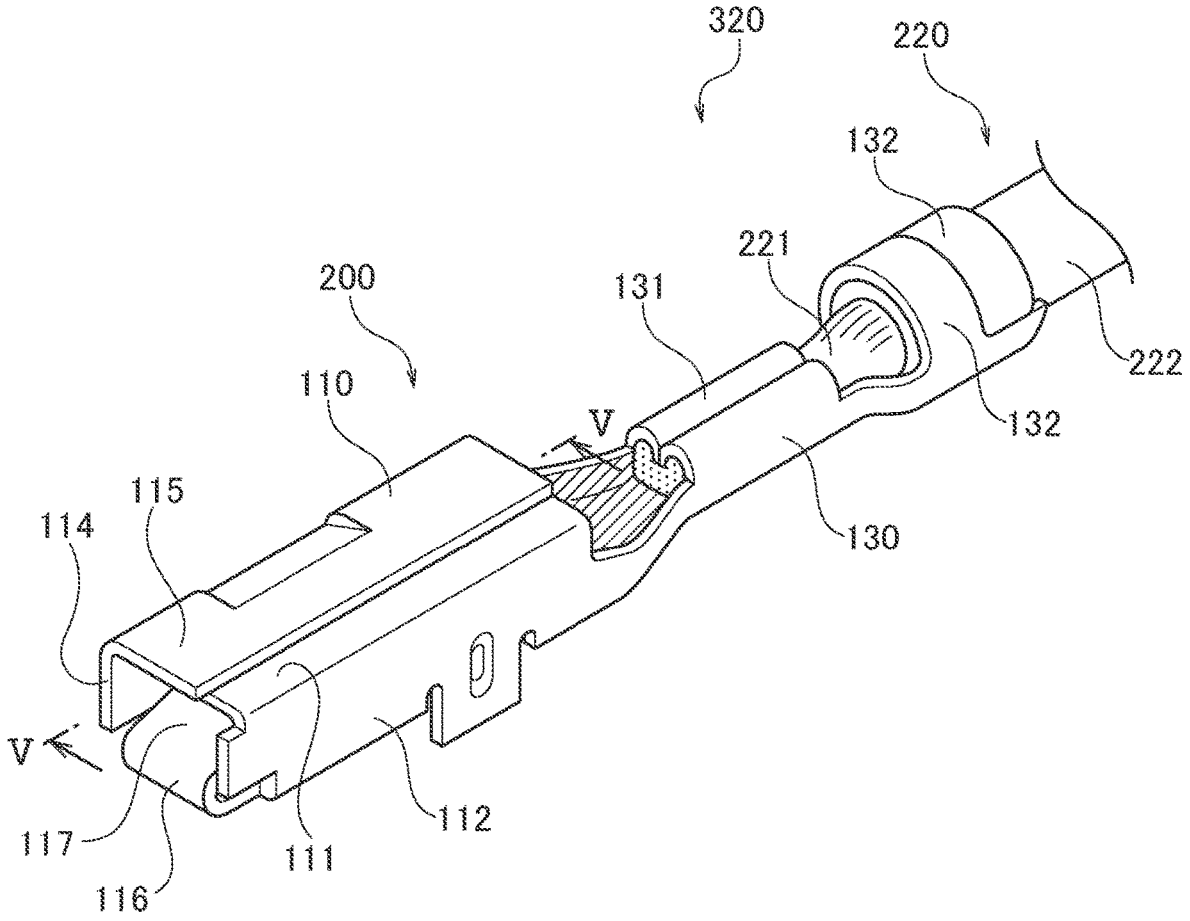
FIG. 4 is a perspective view of an example of an electric wire with terminal in which an electric wire is crimped to the female terminal illustrated in FIG. 1.
Figure 5:
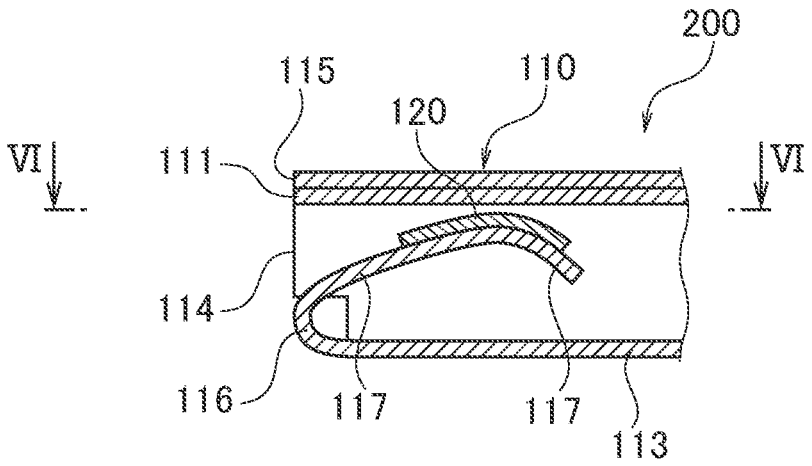
FIG. 5 is a sectional view taken along line V-V in FIG. 4.
Figure 6:
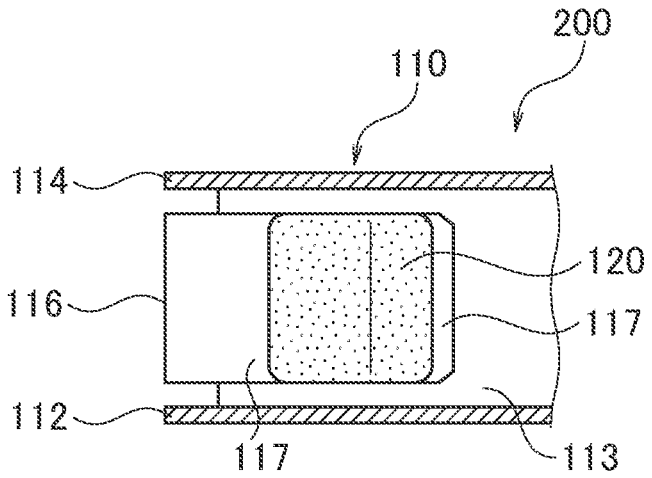
FIG. 6 is a sectional view taken along line VI-VI in FIG. 5.

Next, referring to FIGS. 4 to 6, the female terminal 200 is described. FIG. 4 is a perspective view of an example of an electric wire with terminal 320 in which an electric wire 220 is crimped to the female terminal 200 illustrated in FIG. 1. FIG. 5 is a sectional view taken along line V-V in FIG. 4. FIG. 6 is a sectional view taken along line VI-VI in FIG. 5. As illustrated in FIGS. 4 to 6, the female terminal 200 includes the connecting part 110 and the electrical contact 120. The female terminal 200 may further include a crimping part 130.

The female terminal 200 is formed from an electrically conductive member. The connecting part 110 and the crimping part 130 of the female terminal 200 are formed from a sheet of an electrically conductive member, and the connecting part 110 and the crimping part 130 have electrical conductivity. However, the female terminal 200 may be formed from multiple separate members of different types. The electrically conductive member making up the female terminal 200 may use a material similar to that of the male terminal 100.

The connecting part 110 of the female terminal 200 is electrically conductive and configured to engage with the connecting part 10 of the male terminal 100. As illustrated in FIGS. 4 to 6, the connecting part 110 includes a box body into which the connecting part 10 of the male terminal 100 is to be inserted, and a plate-like body that extends from a part of the box body into the box body to press the connecting part 10 of the male terminal 100 inserted into the box body with elastic force.

The box body of the connecting part 110 of the female terminal 200 includes a first wall part 111, a second wall part 112, a third wall part 113, a fourth wall part 114, and a fifth wall part 115, and the fifth wall part 115 overlaps the outside of the first wall part 111, forming a box-shaped body. These wall parts are bent to be substantially square in a direction perpendicular to the connecting direction of the female terminal 200 and the opposite terminal. The first wall part 111 and the third wall part 113 are opposed to each other with a space substantially in parallel. The second wall part 112 and the fourth wall part 114 are opposed to each other with a space substantially in parallel.

The plate-like body of the connecting part 110 of the female terminal 200 includes an elastic part 116 provided continuously and strongly bent at an end in the longitudinal direction of the third wall part 113, and a sliding part 117 provided continuously and weakly bent at the end of the elastic part 116. That is, the elastic part 116 is provided to have an inner angle smaller than that of the sliding part 117.

The elastic part 116 is formed from the same material as that of other parts making up the connecting part 110, such as the third wall part 113, but is provided with a strong elastic force due to its bent shape. The sliding part 117 is formed from the same material as that of other parts making up the connecting part 110, such as the third wall part 113, but is provided with a weak elastic force due to its bent shape. When the male terminal 100 and the female terminal 200 are engaged with each other, the sliding part 117 of the connecting part 110 of the female terminal 200 has an action of being pressed by the strong elastic force of the elastic part 116 and the weak elastic force of the sliding part 117 against the electrical contact 20 of the male terminal 100.

The electrical contact 120 is provided on at least a part of the surface of the connecting part 110. At least the part of the surface of the connecting part 110 may be on a side of the connecting part 110 that contacts the male terminal 100 through the electrical contact 120 of the female terminal 200 when engaged with the male terminal 100. The electrical contact 120 is provided on a part of an outer angle side of two sides, each of which has a large area, included in the surface of the sliding part 117 weakly bent. The electrical contact 120 is provided on a side of the sliding part 117 proximate to the first wall part 111. The electrical contact 120 of the female terminal 200 is configured to be physically and electrically connected to the electrical contact 20 of the male terminal 100 when engaged with the male terminal 100.

The electrical contact 120 is formed from a graphene oxide film. The graphene oxide film may use a graphene oxide film similar to that used for the electrical contact 20 of the male terminal 100. That is, the graphene oxide film is graphene oxide or a stack of graphene oxide. The thickness of the graphene oxide film is 1 nm or more and 50 nm or less.

The crimping part 130 is connected to the connecting part 110 and is configured to crimp the electric wire 220. The crimping part 130 includes a conductor crimping part 131 for crimping a conductor 221 of the electric wire 220, and a covering material crimping part 132 for crimping a covering material 222 of the electric wire 220. In the crimping part 130, at least the conductor crimping part 131 is formed from a material having electrical conductivity. For the electrically conductive material, a material similar to that used for the connecting part 110 of the female terminal 200 is used, for example.

The electric wire 220 includes the conductor 221 and the covering material 222 covering the conductor 221. For the electrically conductive member used for the conductor 221 of the electric wire 220, an electrically conductive member similar to that used for the conductor 211 of the electric wire 210 is used, for example. For the material used for the covering material 222 of the electric wire 220, a material similar to that used for the covering material 212 of the electric wire 210 is used, for example.

As described above, the electrical connection component according to the present embodiment includes a connecting part that is electrically conductive, and an electrical contact on at least a part of a surface of the connecting part, the electrical contact including a graphene oxide film. The graphene oxide film is graphene oxide or a stack of graphene oxide, and a thickness of the graphene oxide film is 1 nm or more and 50 nm or less. Accordingly, the electrical connection component according to the present embodiment has low electrical resistance while using graphene oxide.

The electrical connection component is, for example, an electrical component electrically connectable to an opposite electrical component. The electrical connection component is not limited as long as it exhibits the effect according to the present embodiment. The electrical connection component includes, for example, a terminal, such as the above-described male or female terminal, a terminal of a card edge connector, a ring terminal, or a U-shaped terminal. The electrical connection component may be a connector terminal.

The electrical connection component may be either a male terminal or a female terminal. The connecting part 10 of the male terminal 100 is pulled out from or inserted into the connecting part 110 of the female terminal 200 while the electrical contact 20 of the male terminal 100 and the electrical contact 120 of the female terminal 200 are in contact with each other (see FIG. 1). Since the graphene oxide film has the same high chemical stability and mechanical strength as graphene, forming the electrical contact with the graphene oxide film improves the contact reliability of the male terminal or the female terminal. The electrical connection component may be the above-described male terminal. The electrical connection component may be the above-described female terminal. As illustrated in FIG. 1, the electrical connection component as the male terminal 100 and the electrical connection component as the female terminal 200 may be physically and electrically connected to each other. When the male terminal and the female terminal are connected each other, the above-described electrical contact may be provided on only one of the male terminal or the female terminal.

[Method of Manufacturing Electrical Connection Component]

Next, a method of manufacturing an electrical connection component according to the present embodiment is described. In a method of manufacturing an electrical connection component, a graphene oxide film is formed by an electrophoretic deposition method. The manufacturing method may include a step of forming a graphene oxide film on the surface of a metal base material by the electrophoretic deposition method.

The electrophoretic deposition method is a technique used to form a film on an electrode. The electrophoretic deposition method is a film deposition method in which charged particles in a dispersion are migrated to be deposited on an electrode by applying a voltage between electrodes of an anode and a cathode inserted in the dispersion, for example. The electrophoretic deposition method does not need heat treatment and can form a film in a non-vacuum state at normal temperature, and it is thus possible to easily form a graphene oxide film at low cost.

Figure 7:
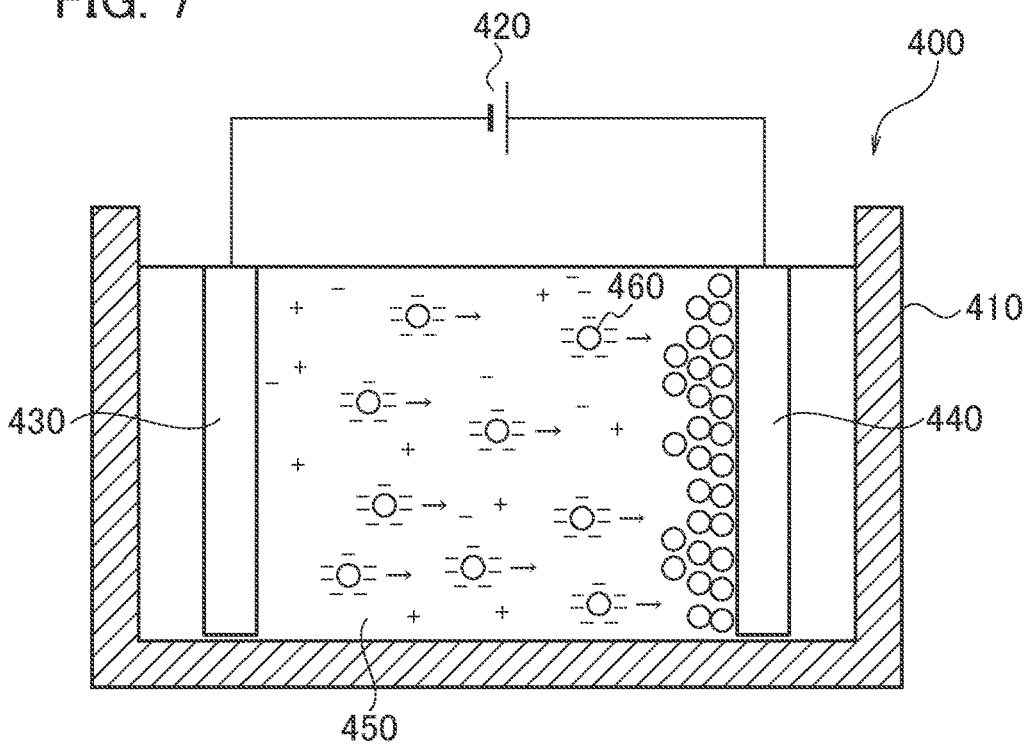
FIG. 7 is a schematic diagram illustrating a state of forming a graphene oxide film by an electrophoretic deposition method.

FIG. 7 illustrates an electrophoresis apparatus 400 used in the electrophoretic deposition method. The electrophoresis apparatus 400 includes an electrophoresis tank 410, a cathode 430 connected to the negative electrode of a DC power source 420, and a metal base material 440 connected to the positive electrode of the DC power source 420. In the present embodiment, the metal base material 440 is an anode. The electrophoresis tank 410 stores a dispersion 450 in which graphene oxide 460 is dispersed in water. When the DC power source 420 applies a voltage between the cathode 430 and the metal base material 440 (anode), the graphene oxide 460 having a negative zeta potential moves toward the metal base material 440. As a result, as illustrated by hollow circles, the graphene oxide 460 is deposited on the surface of the metal base material 440.

The metal base material is a member on which the connecting part of the electrical connection component is based. The metal base material is not limited, and the member used in the above-described connecting part can be used. The metal base material is preferably formed from an electrically conductive metal, such as copper, aluminum, iron, magnesium, or an alloy containing one of these metals. The shape of the metal base material includes various shapes, such as a plate-like shape, a rod-like shape, or a shape obtained by combining these shapes, and the size, such as the thickness, can be selected variously according to the application.

It is preferable to remove the oxide film on the surface of the metal base material before forming the graphene oxide film on the metal base material. The method for removing the oxide film is not limited, and the oxide film may be removed physically by polishing or the like or may be removed chemically by a chemical solution. The chemical solution can be appropriately selected according to the characteristics of the oxide film. The chemical solution may be, for example, an acidic solution, such as sulfuric acid, hydrochloric acid, or nitric acid.

It is also preferable to smooth the surface of the metal base material before forming the film on the metal base material. The method for smoothing the surface of the metal base material is not limited, and the surface of the metal base material may be smoothed by polishing, for example. Among polishing, it is preferable to smooth the surface of the metal base material by chemical mechanical polishing. Chemical mechanical polishing (CMP) is a method for smoothing the surface of a metal base material by applying a chemical solution, such as an acid or a base, to the surface of the metal base material and mechanically polishing the surface of the metal base material with particles such as polishing particles. With the CMP, the surface of the metal base material can be modified to be easily polished by the chemical solution, and thus the mechanical polishing becomes easy and results in a smooth and good surface finish.

The cathode is not limited and may be a soluble cathode or an insoluble cathode. The soluble cathode may be a copper-containing metal, such as high phosphorous copper, electrolytic copper or oxygen free copper, or a nickel-containing metal, such as nickel or a nickel alloy. The insoluble cathode may be carbon, platinum, titanium coated with platinum, or the like.

The dispersion contains graphene oxide. The dispersion may be prepared by dispersing graphene oxide in water or may be a commercially available graphene oxide dispersion. Graphene oxide can be prepared by known methods, but commercially available graphene oxide may be used.

In the present embodiment, the graphene oxide film is preferably a single layer having a size of 1 μm to 10 μm. Here, the size of the graphene oxide film means the average of the maximum length and the minimum length of the surface of the graphene oxide film.

Graphene oxide may have a structure in which a functional group having oxygen, such as a carboxyl group, a hydroxyl group, an epoxy group, or a carbonyl group, is bonded to the graphene. Since the oxygen in the functional group of the graphene oxide is negatively charged in a solution having polarity, the graphene oxide is hard to aggregate with different graphene oxide. Accordingly, graphene oxide is easily dispersed uniformly in a polar solvent.

As described above, when an electrically conductive metal is intercalated between layers of graphene oxide, the dispersion may include a salt of an electrically conductive metal, for example. Examples of the salt of the electrically conductive metal include sulfate or nitrate. The concentration of the salt of the electrically conductive metal in the aqueous dispersion is preferably from 0.0005 to 0.01% by mass, more preferably from 0.001 to 0.002% by mass from the viewpoint of reducing the electrical resistance of the graphene oxide film. The mass ratio of the salt of the electrically conductive metal to the graphene oxide in the aqueous dispersion is preferably 0.01 to 0.1, and more preferably 0.02 to 0.04, from the viewpoint of forming a graphene oxide film in which the electrically conductive metal is appropriately intercalated.

Figure 8:
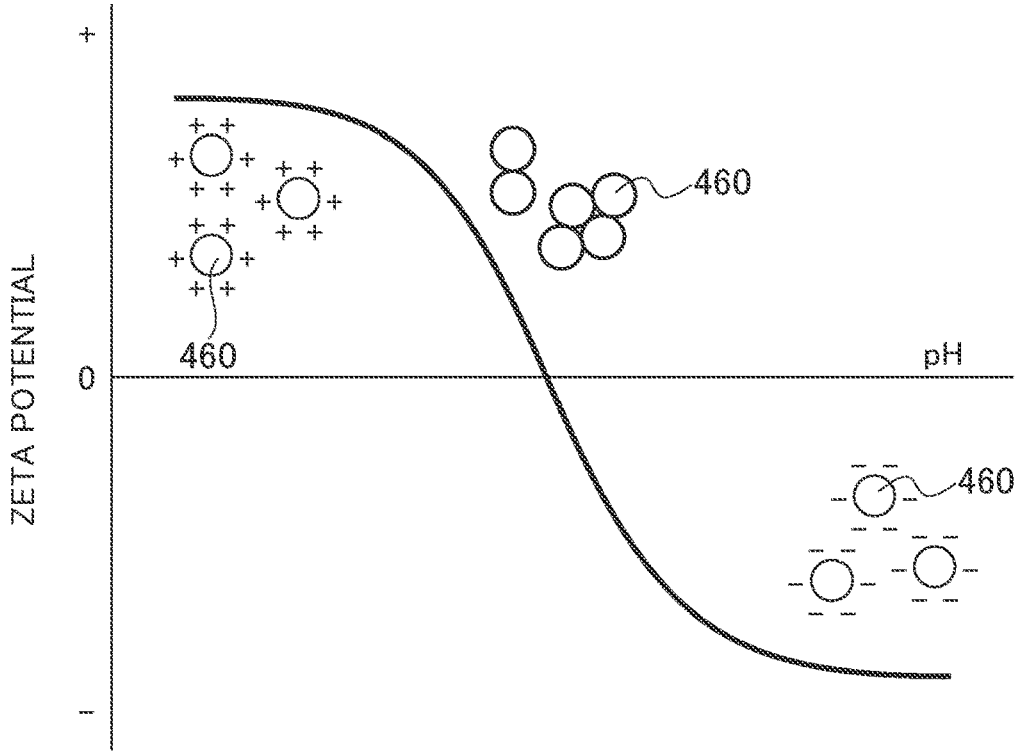
FIG. 8 is a graph illustrating a relationship between pH of a dispersion and zeta potential of graphene oxide.

When the electrically conductive metal is intercalated between the layers of the graphene oxide, the dispersion may be prepared so that the zeta potential of the graphene oxide is positive. This preparation can be performed by controlling the pH of the dispersion. The relationship between the pH of the dispersion and the zeta potential of graphene oxide is described. FIG. 8 is a graph illustrating the zeta potential of graphene oxide relative to the pH of the dispersion. As seen from FIG. 8, to make the zeta potential of graphene oxide positive, the pH of the dispersion needs to be reduced. Specifically, the pH of the dispersion is preferably 1 to 7, and more preferably 1 to 3. To reduce the pH of the dispersion, an acid may be added, and examples of the acid include sulfuric acid, hydrochloric acid, or nitric acid. In the present embodiment, it is preferable to control the pH by adding 0.1M sulfuric acid.

The dispersion may contain various additives in addition to graphene oxide. The dispersion may include, for example, a pH buffer, a preservative, or the like.

The thickness of the graphene oxide film is controlled by adjusting the concentration of graphene oxide in the dispersion, the voltage between the anode and cathode electrodes, the current density, the application time of the voltage, or the distance between the electrodes.

In the present embodiment, the concentration of graphene oxide in the dispersion is preferably 0.001 to 100 mg/L, more preferably 0.005 to 50 mg/L, from the viewpoint of forming a graphene oxide film having an appropriate thickness.

The voltage applied between the anode and cathode electrodes is preferably 1V or more and 5V or less. Setting the voltage in such a range makes the thickness of the graphene oxide film appropriate. From the viewpoint of reducing the thickness of the graphene oxide film, the voltage applied between the anode and cathode electrodes is more preferably 4V or less, and further preferably 3V or less.

The application time of the voltage depends on the voltage but is preferably 0.1 minute or more and 4 minutes or less. Setting the application time to 0.1 minute or more forms a good graphene oxide film on the metal base material. Setting the application time to 4 minutes or less reduces the film thickness of the graphene oxide film. The application time of the voltage is more preferably 1 minute or more. The application time of the voltage is more preferably 3 minutes or less.

The distance between the anode and cathode electrodes is preferably 5 mm or more and 20 mm or less. Setting the distance between the electrodes to 5 mm or more reduces the film thickness of the graphene oxide film. Setting the distance between the electrodes 20 mm or less forms a good graphene oxide film on the metal base material. The distance between the electrodes is more preferably 8 mm or more, and further preferably 10 mm or more. The distance between the electrodes is more preferably 15 mm or less.

According to the electrophoretic deposition method, the graphene oxide moves by a Coulomb force due to an external electric field and deposits firmly on the surface of the metal base material. Accordingly, the adhesion between the graphene oxide film and the metal base material obtained in the present embodiment is higher than that formed by a film forming method, such as spin coating in which van der Waals force becomes a factor of the adhesion. The adhesion force of graphene oxide is controlled by Coulomb force. When the external electric field is E (N/C) and the electric charge is q (C), the Coulomb force F (N) is given by $F=qE$. That is, the Coulomb force applied to the graphene oxide in the dispersion is controlled by the charge of the graphene oxide or the external electric field. The external electric field depends on the applied voltage and thus is adjusted by the applied voltage. The charge of the graphene oxide is controlled by the zeta potential, that is, by the pH of the dispersion, as described above. Accordingly, increasing the applied voltage and/or decreasing the pH of the dispersion increases the Coulomb force and improves the adhesion between the graphene oxide film and the metal base material.

The connecting part of the electrical connection component illustrated in FIGS. 1 to 6 has the graphene oxide film provided on at least a part of the surface of the connecting part. That is, the connecting part may include a region on which the graphene oxide film is not formed. Such a region is provided by masking the metal base material during treatment by the electrophoretic deposition method. Specifically, a mask is disposed on a region for not forming the graphene oxide film and then removed after the process of the electrophoretic deposition method.

After the graphene oxide film is formed as described above, the metal base material is pulled up from the dispersion and then dried. The drying temperature for drying the graphene oxide film is preferably 80 to 120° C. The drying time is preferably 5 to 30 minutes. The drying atmosphere is preferably an inert gas atmosphere, such as nitrogen, to prevent oxidation of the metal base material.

As described above, a graphene oxide film is formed on a metal base material by the electrophoretic deposition method. Since the graphene oxide film is a thin film, it has low electrical resistance and excellent adhesion. It is thus useful as an electrical contact of an electrical connection component.

The graphene oxide film may be used as an electrical contact as it is, but the graphene oxide may be reduced to further reduce the electrical resistance. The reduction can be carried out by a known method, such as a chemical reduction treatment, a thermal reduction treatment, or a photoreduction treatment.

EXAMPLES

The present embodiment is described in more detail with reference to examples and comparative examples. However, the present embodiment is not limited to these examples.

Example 1

A dispersion containing graphene oxide was prepared by adding graphene oxide to water so that the concentration was 4 mg/L. A copper metal base material was inserted as an anode into an electrophoresis tank storing the dispersion, and a metal base material similar to the anode was inserted as a cathode into the electrophoresis tank. The cathode and the anode were fixed to the electrophoretic tank such that the distance between the electrodes of the cathode and the anode was 10 mm. The cathode and the anode were then connected to a DC power source, and a DC voltage of 3V was applied between the cathode and the anode for 3 minutes. In this manner, a graphene oxide film was deposited on the surface of the metal base material by the electrophoretic deposition method, and a test sample was prepared.

Example 2

A test sample was prepared in the same manner as in Example 1 except that the concentration of graphene oxide was 40 mg/L.

Example 3

A test sample was prepared in the same manner as in Example 1 except that the concentration of graphene oxide was 40 mg/L and the application time was 5 minutes.

Example 4

A test sample was prepared in the same manner as in Example 1 except that the concentration of graphene oxide was 40 mg/L and the application time was 10 minutes.

Comparative Example 1

A test sample was prepared in the same manner as in Example 1 except that the concentration of graphene oxide was 40 mg/L and the application time was 20 minutes.

[Evaluation]

The film thickness and contact resistance of the graphene oxide films in the test samples prepared as described above were measured by an atomic force microscope (AFM). As the AFM, Park NX 10 provided by Park Systems was used. To measure the film thickness and contact resistance of graphene oxide at the same time, the AMF measurement mode was set to Conductive AFM. In the conductive AFM mode, while the surface shape is measured, a constant bias voltage is applied between the cantilever and the sample, and the value of the current flowing from the cantilever to the sample is measured. As the cantilever of the AMF, CDT-NCLR-10 coated with conductive diamond on silicon was used. The tip of the CDT-NCLR-10 has a radius of curvature of 200 nm. The load of the cantilever was set at 980 nN. The contact resistance of the graphene oxide film was calculated from the slope of the obtained I-V curve.

TABLE 1

| | Concentration (mg/L) | Application Time (min) | Film Thickness (nm) | Contact Resistance (M Ω) |
|---|---|---|---|---|
| Example 1 | 4 | 3 | 6 | 11.7 |
| Example 2 | 40 | 3 | 10 | 1.64 |
| Example 3 | 40 | 5 | 30 | 62.1 |
| Example 4 | 40 | 10 | 50 | 82.4 |
| Comparative Example 1 | 40 | 20 | 60 | 100.1 |

As shown in Table 1, in the test samples according to Examples 1 to 4, the concentration of graphene oxide was decreased and/or the application time of the DC voltage was shortened compared with the test sample according to Comparative Example 1, so that the film thickness of graphene oxide was reduced to 50 nm or less. In the test samples according to Examples 1 to 4, the film thickness of graphene oxide was 50 nm or less, and thus the contact resistance of the graphene oxide film was 100 MΩ or less. In contrast, in the test sample of Comparative Example 1, the film thickness of graphene oxide exceeded 50 nm, and thus the contact resistance of the graphene oxide film exceeded 100 MΩ. In the case of contact resistance such as those in the test samples according to Examples 1 to 4, the electrical contact of the terminal is considered to have sufficient electrical conductivity.

The present embodiment has been described with reference to the examples. The present embodiment is however not limited thereto, and various modifications can be made within the scope of the gist of the present embodiment.

What is claimed is:

1. An electrical connection component, comprising:

a connecting part that is electrically conductive; and an electrical contact on at least a part of a surface of the connecting part, the electrical contact comprising a graphene oxide film, wherein the graphene oxide film is graphene oxide or a stack of graphene oxide, and a thickness of the graphene oxide film is 1 nm or more and 50 nm or less.

2. The electrical connection component according to claim 1, wherein the electrical connection component is either a male terminal or a female terminal.

3. A method of manufacturing the electrical connection component comprising:

providing a connecting part that is electrically conductive; and an electrical contact on at least a part of a surface of the connecting part, having the electrical contact with a graphene oxide film, wherein the graphene oxide film is graphene oxide or a stack of graphene oxide, and a thickness of the graphene oxide film is 1 nm or more and 50 nm or less;

forming the graphene oxide film by an electrophoretic deposition method.

* * * * *